US005425696A

United States Patent [19]

Hara et al.

[11] Patent Number: 5,425,696

[45] Date of Patent: Jun. 20, 1995

[54] SWING CHUTE PAPER FOLDING APPARATUS WITH ACTIVE GUIDE

[75] Inventors: Akihiko Hara; Michita Igarashi; Tadashi Takei; Yukio Kanazawa, all of Saitama, Japan

[73] Assignee: Fuji Xerox Co., Ltd., Tokyo, Japan

[21] Appl. No.: 19,295

[22] Filed: Feb. 18, 1993

[30] Foreign Application Priority Data

Feb. 19, 1992 [JP] Japan ..... 4-032065
Feb. 26, 1992 [JP] Japan ..... 4-039257

[51] Int. Cl.[6] ..... B65H 45/20; B65H 45/14; B65H 45/107

[52] U.S. Cl. ..... 493/414; 493/412; 493/419

[58] Field of Search ..... 493/412, 414, 419, 421, 493/442, 443, 458

[56] References Cited

U.S. PATENT DOCUMENTS

| | | | |
|---|---|---|---|
| 3,747,917 | 7/1973 | Roda | 493/419 |
| 4,484,905 | 11/1984 | Ashburner | 493/415 |
| 4,985,013 | 1/1991 | van der Werff et al. | 493/442 |
| 5,090,671 | 2/1992 | Gombault et al. | 493/419 |
| 5,135,465 | 8/1992 | Hirahara | 493/442 |
| 5,201,700 | 4/1993 | Meschi | 493/415 |

FOREIGN PATENT DOCUMENTS

| | | |
|---|---|---|
| 46-5909 | 12/1971 | Japan . |
| 49-8319 | 1/1974 | Japan . |
| 61-226461 | 10/1986 | Japan . |

*Primary Examiner*—William E. Terrell
*Attorney, Agent, or Firm*—Finnegan, Henderson, Farabow, Garrett & Dunner

[57] ABSTRACT

A paper folding apparatus for folding a copied sheet of paper discharged from a copying machine. The apparatus includes a feed roller pair for feeding a sheet of paper, a first folding roller pair, a second folding roller pair. This second folding roller pair is disposed in opposition to the first folding roller pair, for folding the sheet of paper fed from the feed roller pair in cooperation with the first folding roller pair. A swingable paper guide unit is disposed above the first and second folding roller pairs, for guiding the sheet of paper fed from the feed roller pair selectively to the first folding roller pair or the second folding roller pair. A paper guide plate is disposed between the first and second folding roller pairs, for leading a leading edge of the sheet of paper guided by the paper guide unit to a nip portion of the first folding roller pair or the second folding roller pair. Finally a paper-thrust-posture adjusting unit is provided for adjusting a posture of the leading edge of the sheet of paper when the sheet is forcibly put into the nip portion according to a state of the leading edge of the sheet particularly when the sheet is curled.

2 Claims, 10 Drawing Sheets

SWING CHUTE PAPER FOLDING APPARATUS WITH ACTIVE GUIDE

BACKGROUND OF THE INVENTION

1. Field of the Invention

The present invention relates to a paper folding apparatus for folding printed sheets of paper discharged out of a printing machine, such as a copying machine.

2. Discussion of the Related Art

In a general copying machine, a sheet of recording paper flows through the machine in the following way. The sheet, which is fed from a paper supply cassette into the copying machine, first reaches an image forming stage for transferring a latent electrostatic image on the sheet. The sheet bearing the latent image is transported to a transfer/fusing stage where the latent image is transferred and fused onto the sheet. The sheet with the fused image is discharged from the copying machine into a paper receiving tray, and stored therein.

In a copying machine capable of copying original documents of large size, drawings or graphic images are frequently copied on recording sheets of paper of large size, for example, A0 or A1. Generally, the copied, large sheets are manually folded to have the size easy to handle and store. The manual folding work is troublesome and time consuming. Frequently, it takes time period several times as long as a copying time.

To cope with this, there have been proposed automatic folding apparatuses in use with copying machines. For those apparatuses, reference is made to Japanese Patent Unexamined Publication Nos. Sho. 46-5909, 49-8319, and 61-226461, for example.

The mechanical construction of a conventional paper folding apparatus is schematically illustrated in FIG. 1. As shown in FIG. 1, the paper folding apparatus 10 includes a feed roller pair 11 consisting of a drive roller 11*a* and a pinch roller 11*b*, a first folding roller pair 12 consisting of a drive roller 12*a* and a pinch roller 12*b*, and a second folding roller pair 13 consisting of a drive roller 13*a* and a pinch roller 13*b*. Under the feed roller pair 11, the first and second folding roller pairs 12 and 13 are disposed symmetrically with respect to the vertical line extended down from the feed roller pair 11. The apparatus 10 further includes a paper guide 15 for guiding a sheet of paper 14 fed from the feed roller pair 11 selectively to the first or second folding roller pair. The paper guide 15 can be swung about a shaft 15*a* by means of a drive mechanism (not shown). A paper guide plate 16, further provided in the apparatus 10, is disposed between the first and second folding roller pairs 12 and 13. The guide plate 16 selectively guides the sheet of paper 14 toward the first folding roller pair 12 or the second folding roller pair 13.

A feed roller pair 18 consisting of a drive roller 18*a* and a pinch roller 18*b* feeds the sheet of paper 14 through a paper feed path 17 to between the rollers of the feed roller pair 11 in the paper folding apparatus 10. The sheet 14 is fed into the paper guide 15 by means of the feed roller pair 11. Then, it is selectively guided, by means of the paper guide 15 to the first folding roller pair 12 or the second folding roller pair 13. In the illustration of FIG. 2, the paper guide 15 is going to guide the sheet 14 to between or the nip of the paired rollers of the second folding roller pair 13. When the first and second roller pairs 12 and 13 repeat the forward and reverse turns, the paper guide 15 swings about the shaft 15*a*. The leading edge of the sheet 14 slides along the upper surface of the guide plate 16 to alternately be applied to the paired rollers of the roller pairs 12 and 13. In this way, the sheet 14 is progressively folded a predetermined number of times.

In order to fold a large sheet of paper 14 of size A0, for example, to have the size of A4, two paper folding sections each having the construction like that of the paper folding apparatus 10 are used; a first folding section folds the sheet of paper in a first direction, and a second folding section further folds the folded sheet in a second direction at a right angle to the first direction. Examples of the sheets 14 folded by the first folding section, just before they are put into the nip of the second folding section, are illustrated in FIGS. 3(A) and 3(B). In the second folding section, the folded sheet 14 is put into the nip of the second folding roller pair designated by reference numeral 13 in the paper folding apparatus 10.

The paper folding operation in the second folding section will be described with reference to FIG. 2. The leading edge of the sheet of paper 14 is first put into the nip of the first folding roller pair 12, as indicated by a solid line. Then, the paper guide 15 turns toward the second folding roller pair 13, while at the same time the rollers of the first folding roller pair 12 turn in the directions of arrows. As the result of the paper guide turn and the roller turn, the sheet of paper 14 is moved toward the second folding roller pair 13 to be shaped as indicated by a dotted line. The folded sheet thus shaped is put into the nip of the second folding roller pair 13, and is folded in the second direction.

When a roll of paper is used as the sheet 14, the sheet is inevitably curled. Accordingly, a posture of the leading edge of the rolled or curled sheet when it is forcibly put into the nip of the paired rollers (this posture will be referred to as a "paper thrust posture") is different from that of the flat sheet of paper, such as a cut sheet or a continuous sheet of paper. Further, the paper thrust posture for the first folding roller pair 12 is often different from that for the second folding roller pair 13.

The paper thrust postures of a flat sheet of paper and upward and downward curled sheets of paper are illustrated in FIGS. 4(A) to 4(C). In FIG. 4(A), a flat sheet of paper 14 slides on the guide plate 16 and its leading edge 14*a* is inserted between the rollers (into a nip point) of the folding roller pair uniformly over its entire width. Accordingly, the sheet 14 can be stably folded by the folding roller pair.

In the case of FIG. 4(B) or 4(C), however, the sheet of paper 14 is put into the nip of the folding roller pair in a state that the leading edge 14*a* is curled upwardly or downwardly. In this case, the leading edge 14*a* of the sheet hits the pinch roller 12*b* or the drive roller 12*a* before it reaches the nip. If such a state occurs even at a part of the leading edge width of the sheet, a twisting force acts on the sheet 14 moving toward the nip to crease the sheet when it is folded.

Further, in the case of the large size sheet of paper, the sheet 14 is folded in the first direction, and then is folded again in the second direction. When the folded sheet is put into the nip of the second folding roller pair for the second folding, the creased side 14*a* of the folded sheet is slackened since the creased side 14*a* is more impeded than the other side 14*b*, or the side not creased, of the folded sheet. The folded sheet is folded again in a state that the creased side is slackened. Accordingly, the resultant folded sheet tends to have wrinkle 17*a* in the creased side 14*a*.

SUMMARY OF THE INVENTION

The present invention has been made in view of the above circumstances and has an object to provide a paper folding apparatus which can fold a printed sheet of paper without wrinkle even when the leading edge of the sheet is put into the nip of the folding roller pair nonuniformly over its entire width.

Another object of the invention is to provide a paper folding apparatus which can exactly put the leading edge of a curled sheet into the nip of the folding roller pair, thereby creating no wrinkle in the creased side of the sheet.

Yet another object of the invention is to provide a paper folding apparatus which can smoothly put the creased side of the folded sheet into the nip of the folding roller pair, thereby creating no wrinkle in the creased side of the sheet.

To attain the above objects, the invention provides a paper folding apparatus including: a feed roller pair for feeding a sheet of paper; a first folding roller pair; a second folding roller pair, disposed in opposition to the first folding roller pair, for folding the sheet of paper fed from the feed roller pair in cooperation with the first folding roller pair; swingable paper guide means, disposed above the first and second folding roller pairs, for guiding the sheet of paper fed from the feed roller pair selectively to the first folding roller pair or the second folding roller pair; a paper guide plate, disposed between the first and second folding roller pairs, for leading a leading edge of the sheet of paper guided by the paper guide means to a nip portion of the first folding roller pair or the second folding roller pair; and paper-thrust-posture adjusting means for adjusting a posture of the leading edge of the sheet of paper when the sheet is forcibly put into the nip portion according to a state of the leading edge of the sheet particularly when the sheet is curled.

Also, the invention provides a paper folding apparatus for folding a folded sheet of paper including: a feed roller pair for feeding the sheet of paper folded in a first direction; a first folding roller pair; a second folding roller pair, disposed in opposition to the first folding roller pair, for folding in a second direction the sheet of paper fed from the feed roller pair in cooperation with the first folding roller pair; swingable paper guide means, disposed above the first and second folding roller pairs, for guiding the sheet of paper fed from the feed roller pair selectively to the first folding roller pair or the second folding roller pair, the paper guide means including creased-side pressing means for pressing a creased side of the folded sheet; and a paper guide plate, disposed between the first and second folding roller pairs, for leading a leading edge of the folded sheet guided by the paper guide means to a nip portion of the first folding roller pair or the second folding roller pair.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENT

An embodiment of the present invention, which is believed to be preferred, will be described with reference to the accompanying drawings.

Figure 6:
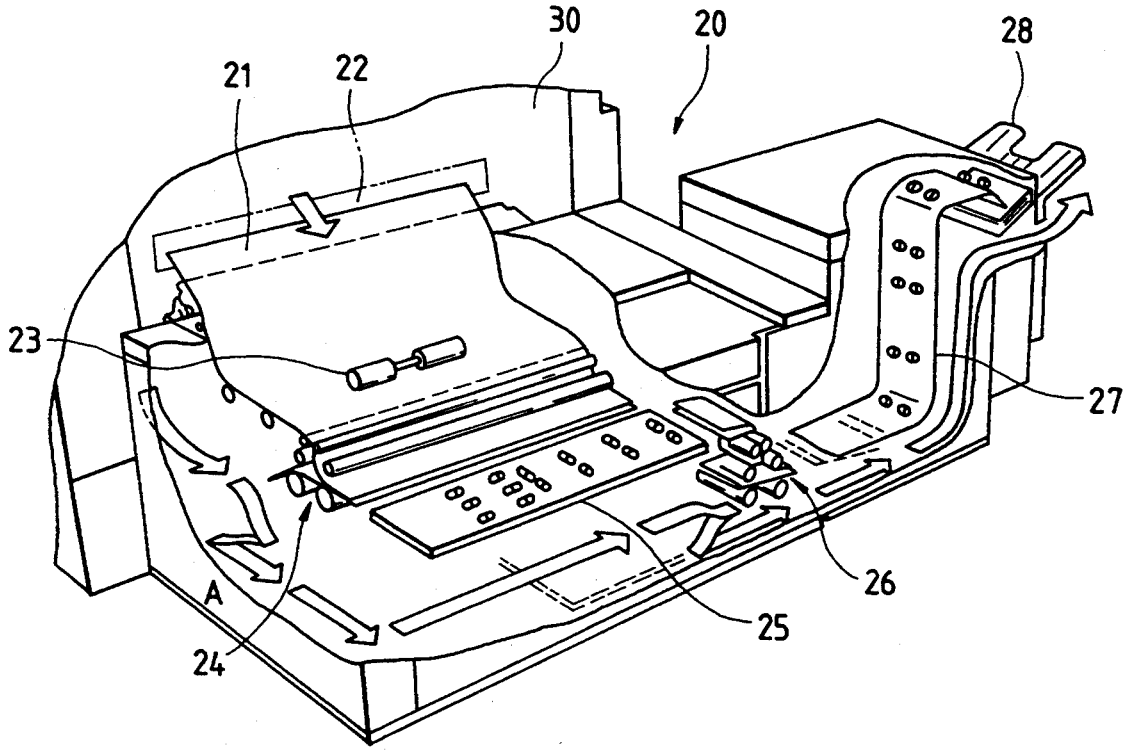
FIG. 6 is a perspective view, broken in part, showing an overall construction of a paper folding apparatus according to an embodiment of the present invention.

FIG. 6 is a perspective view, broken in part, showing an overall construction of a paper folding apparatus according to an embodiment of the present invention.

A printed sheet of paper 21 emanates from an exit on the rear side of a copying machine 30, and enters a paper folding apparatus 20, through a paper receiving section 22. Then, the sheet 21 passes through a registration roller 23 and enters a first folding section 24. In this folding section 24, the sheet is folded in the paper feed direction A (first direction). Thereafter, it is turned by 90° in its advancing direction by a known turning section 25, and guided to a second folding section 26. In this folding section 26, the sheet 21 is folded again in the second direction at a right angle to the first direction. Thereafter, the folded sheet is discharged into a tray 28 where it is piled up.

Figure 7:
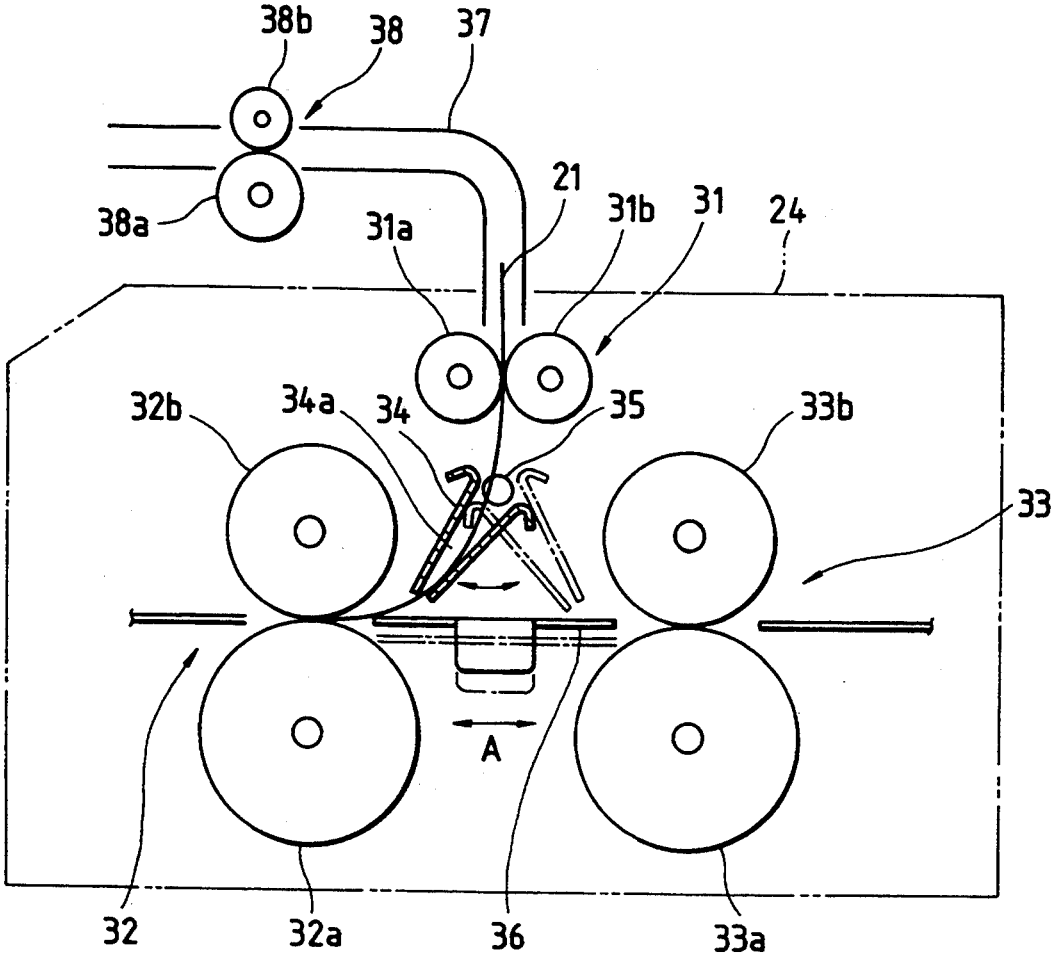
FIG. 7 is a side view showing a first folding section of the paper folding apparatus of FIG. 6.

FIG. 7 is a side view showing the construction of the first folding section 24 of the paper folding apparatus 20.

As shown in FIG. 7, the first folding section 24 includes a feed roller pair 31 consisting of a drive roller 31*a* and a pinch roller 31*b*, a first folding roller pair 32 consisting of a drive roller 32*a* and a pinch roller 32*b*, and a second folding roller pair 33 consisting of a drive roller 33*a* and a pinch roller 33*b*. Under the feed roller pair 31, the first and second folding roller pairs 32 and 33 are disposed symmetrically with respect to the vertical line extended down from the feed roller pair 31. The first folding section 24 further includes a paper guide 34 for guiding the sheet of paper 21 fed from the feed roller pair 31 selectively to the first or second folding roller pair. The paper guide 34 contains a paper path 34*a* therein, which becomes narrower toward the bottom of the paper guide 34. The sheet passes through the paper path 34*a* of the paper guide 34. The paper guide 34 can be swung about a shaft 35, located at the top of the guide, by a guide swing mechanism 40.

Figure 8:
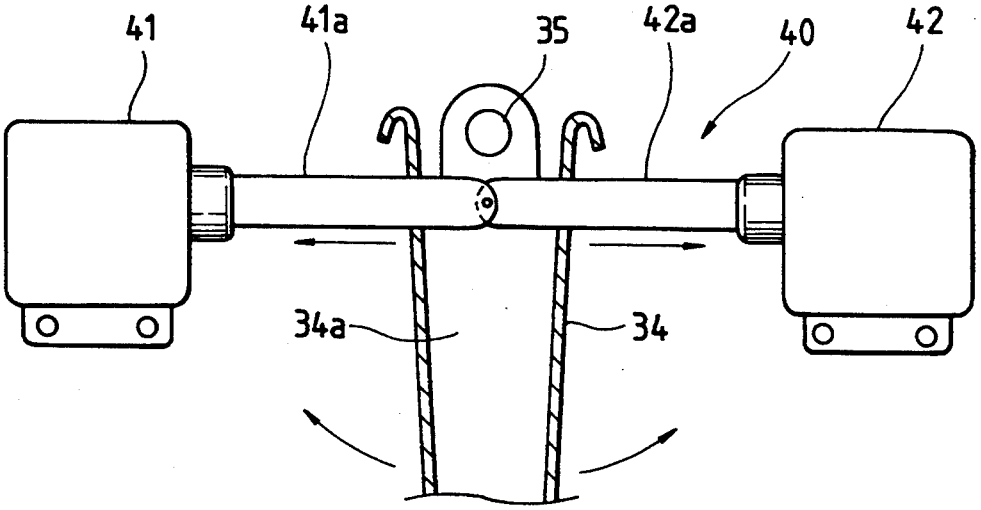
FIG. 8 is a side view showing a guide swing mechanism used in the paper folding apparatus of FIG. 6.

The guide swing mechanism 40 for swinging the paper guide 34 about the shaft 35 is illustrated in detail in FIG. 8. As shown, the guide swing mechanism 40 includes a pair of solenoids 41 and 42, disposed on both sides of the paper guide 34. Drive links 41*a* and 42*a* are inwardly extended from the solenoids 41 and 42, and their distal ends reach under the shaft 35 and are coupled with each other. When the solenoids 41 and 42 are alternately energized, the paper guide 34 are swung within a range defined by a predetermined angle $\theta$ about the shaft 35.

A paper guide plate 36, which is disposed between the first and second folding roller pairs 32 and 33, selectively leads the leading edge 21*a* of the sheet 21 guided by the paper guide 34 to the nip of the first folding roller pair 32 or the second folding roller pair 33. The height of the guide plate 36 is adjusted by a guide-plate height adjusting mechanism 50 (FIG. 9).

Figure 9:
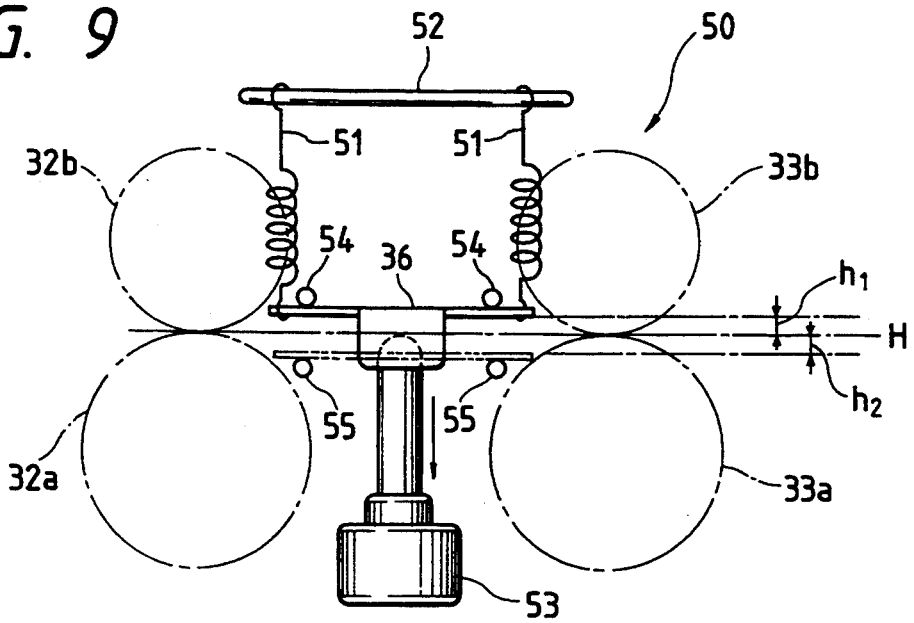
FIG. 9 is a side view showing a guide-plate height adjusting mechanism in the paper folding apparatus of FIG. 6.

A schematic construction of the height adjusting mechanism 50 is illustrated in FIG. 9. The height adjusting mechanism 50 is oppositely disposed on both sides of the guide plate 36 (when viewed in the first direction A). The mechanism 50, mounted between a frame 52 and the guide plate 36, includes a pair of springs 51 for resiliently urging the guide plate 36 in the upward direction, and a solenoid 53, disposed under the guide plate 36, for pulling down the guide plate 36 while resisting the resilient force of the springs 51. A set of upper stoppers 54 and 54 are disposed above the guide plate 36, while another set of lower stoppers 55 and 55 are disposed below the guide plate 36. The upper stoppers 54 are set at a distance $h_1$ higher than a reference position H lying in the horizontal line connecting the nip points of the first and second folding roller pairs 32 and 33. The lower stoppers 55 are set at a distance $h_2$ lower than the reference position H. The height adjusting mechanism 50 functions to set the guide plate 36 at a first position (indicated by a solid line) where it is brought into contact with the stopper 54 by means of the springs 51 or at a second position (indicated by a two-dot chain line) where it is brought into contact with the stoppers 55 by means of the solenoid 53.

The paper folding apparatus thus constructed operates in the following manner. Reference is made to FIG. 7 again. A feed roller pair 38 consisting of a drive roller 38*a* and a pinch roller 38*b* feeds the sheet of paper 21 through a paper feed path 37 to between the rollers of the feed roller pair 31 in the paper folding apparatus 20. The sheet 21 is fed into the paper path 34*a* of the paper guide 34 by means of the feed roller pair 31. Then, it is selectively guided, by means of the paper guide 34 to the first folding roller pair 32 or the second folding roller pair 33. When the first and second roller pairs 32 and 33 repeat the forward and reverse turns, the paper guide 34 swings about the shaft 35. The leading edge 21*a* of the sheet 21 slides along the upper surface of the guide plate 36 to alternately be fed between the paired rollers of the roller pairs 32 and 33. In this way, the sheet 21 is progressively folded a desired number of times.

Figure 10:
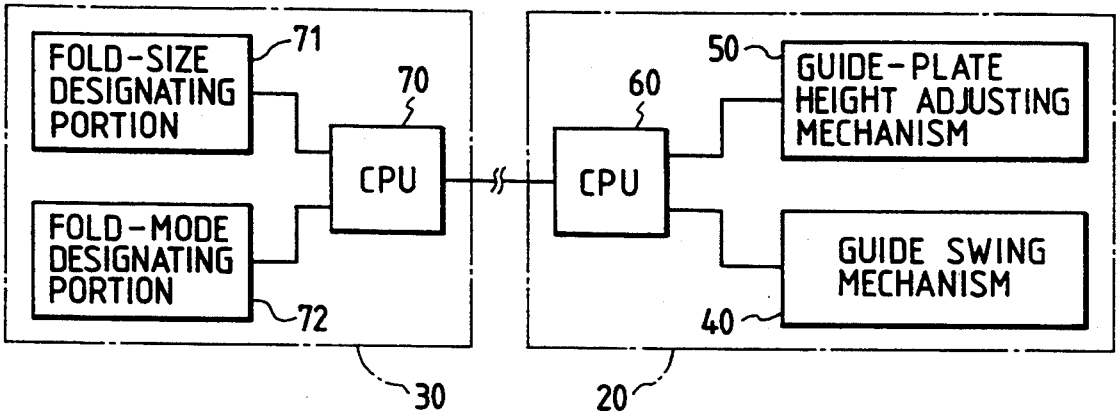
FIG. 10 is a block diagram showing a control unit used in the paper folding apparatus of FIG. 6.
Figure 11:
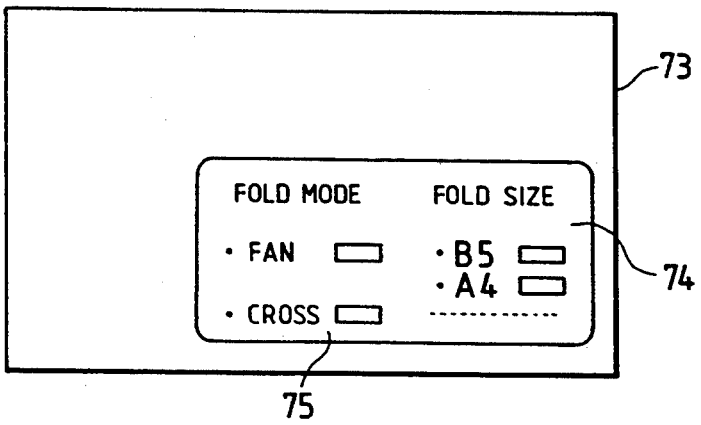
FIG. 11 is a front view showing an operation panel of a copying machine.

A control unit used in the paper folding apparatus 20 will be described. As shown in FIG. 10, the control unit includes a central processing unit (CPU) 60. The CPU 60 is on-line connected to a CPU 70 in the copying machine 30. An operation panel 73 of the copying machine 30 contains keys 74 for designating the size of a folded sheet of paper and keys 75 for designating how to fold the sheet. Those keys 74 and 75 are coupled with a fold-size designating portion 71 and a fold-mode designating portion 72, which are connected to the CPU 70 in the copying machine 30. The CPU 70 receives instructive data signals from the keys through the related portions, and sends the data signals to the CPU 60 in the paper folding apparatus 20. When receiving those data signals, the CPU 60 first determines the direction in which the guide plate 36 is to be turned, and transfers a direction signal to the guide swing mechanism 40. In response to the direction signal, the mechanism 40 drives the paper guide 34 to turn in the determined direction. The CPU 60 also drives the guide-plate height adjusting mechanism 50 to adjust the height of the guide plate 36 according to the curling direction of the leading edge 21*a* of the sheet 21.

The sheet 21 is guided to the first folding roller pair 32 or the second folding roller pair 33 depending on the size of the sheet 21 and the fold mode, as shown in Table 1. In the table, L indicates that the sheet is guided to the first folding roller pair 32 on the left side, and R indicates that the sheet is guided to the second folding roller pair 33 on the right side (FIG. 7).

TABLE 1

| | Fan folding | Cross folding |
|---|---|---|
| A0 | R | L |
| A1 horizontal | L | L |
| A1 vertical | R | L |
| A2 horizontal | L | L |
| A2 vertical | R | L |
| A3 horizontal | R | R |
| A3 vertical | R | L |

As already described, when a roll of paper is used as the recording sheet 21, the leading edge of the sheet is curled. Accordingly, when the conventional paper folding apparatus is used for folding such sheet, the leading edge of the folded sheet is wrinkled.

To cope with the wrinkle problem, the paper folding apparatus 20 in this embodiment gains the best posture of the leading edge 21*a* of the sheet 21 when it thrusts the nip point of each of folding roller pairs 32 and 33. To this end, the embodiment employs two methods; one uses the height adjusting mechanism 50 to adjust the height of the guide plate 36, and the other uses the guide swing mechanism 40 to adjust the inclination of the paper guide 34 to the guide plate 36.

Figure 12A:
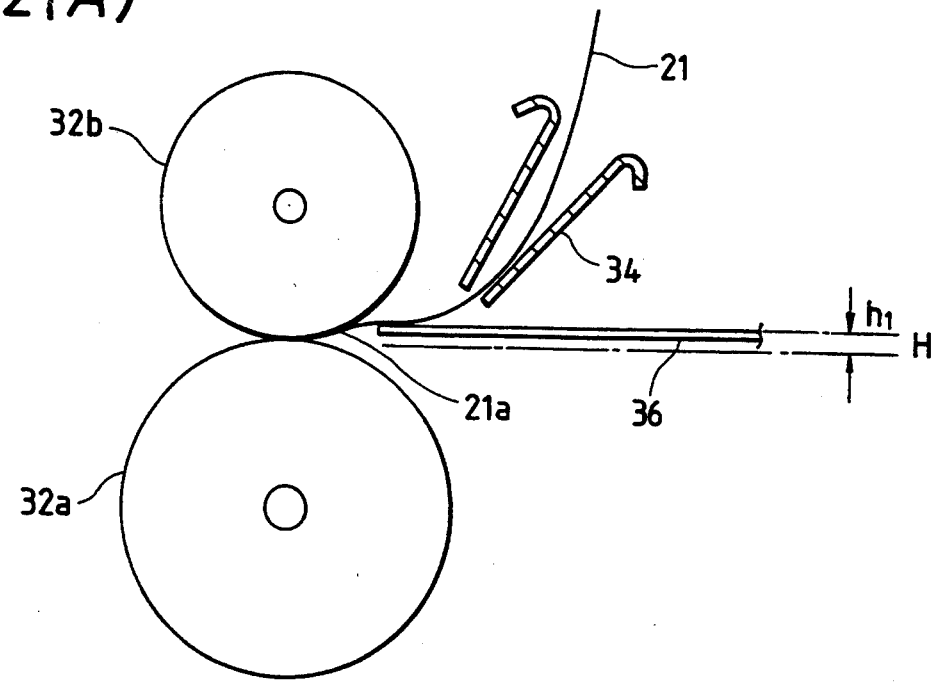
FIGS. 12(A) and 12(B) are side views for explaining a first method to put the leading edge of a curled sheet to the nip of each folding roller pair in the paper folding apparatus of the invention.
Figure 12B:
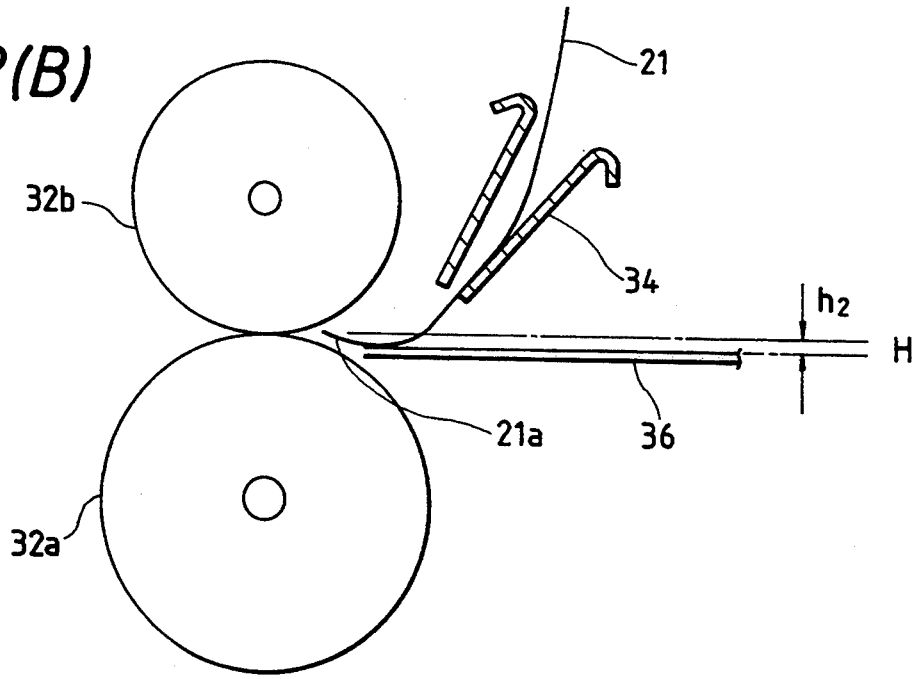

FIGS. 12(A) and 12(B) are side views for explaining a first method to set the leading edge of a curled sheet to the nip of each folding roller pair in the paper folding apparatus.

Two examples are illustrated in those figures; one (FIG. 12(A)) is to set the downward curled leading edge of the sheet to the nip point of the folding roller pair, and the other (FIG. 12(B)) is to set to the upward curled leading edge of the sheet to the same. In this instance, the folding roller pair in each of the examples is the first folding roller pair 32.

In the example of FIG. 12(A), the height adjusting mechanism 50 sets the guide plate 36 at the first position higher than the reference position H by the predetermined distance $h_1$. When the guide plate 36 is at this position, the leading edge 21*a* of the sheet 21 comes in contact with the upper surface of the guide plate 36 and then the sheet moves forward on the upper surface while its leading edge being in contact with the upper surface. After the leading edge passes through the fore end of the guide plate 36, the leading edge moves downward with its urging force to reach a location near to the nip point of the first folding roller pair 32. This posture of the leading edge 21*a* of the sheet 21 allows the leading edge to readily and exactly hit the nip point.

In the example of FIG. 12(B) in which the leading edge of the sheet is curled upward, the height adjusting mechanism 50 sets the guide plate 36 at the second position lower than the reference position H by the predetermined distance $h_2$. When the guide plate 36 is at this position, the leading edge 21*a* of the sheet 21 comes in contact with the upper surface of the guide plate 36 and then the paper moves forward on the upper surface in a state that the leading edge of the sheet is curled upward. Accordingly, after the leading edge passes through the fore end of the guide plate 36, the leading edge reaches a location near to the nip point of the first folding roller pair 32. This posture of the leading edge 21*a* of the sheet 21 also allows the leading edge to readily and exactly hit the nip point.

Since the height of the guide plate 36 is thus adjusted according to the curled state of the leading edge of the sheet 21, the leading edge 21*a* can smoothly enter the nip point of each of the folding roller pair 32 and 33. Accordingly, during the folding process, no twisting force is applied to the sheet 21, and hence the sheet will not be creased.

A second method to set the leading edge of a curled sheet to the nip of each folding roller pair in the paper folding apparatus, will be described with reference to FIGS. 13(A) and 13(B). In the first method, as described above, the best posture of the leading edge 21*a* of the sheet 21 when it enters the nip of the folding roller pair is gained by adjusting the height of the guide plate 36. In the second method, to gain the best posture of the paper leading edge, the inclination of the paper guide 34 to the guide plate 36 is adjusted by the guide swing mechanism 40 according to a curling state of the leading edge 21*a* of the sheet.

Figure 13A:
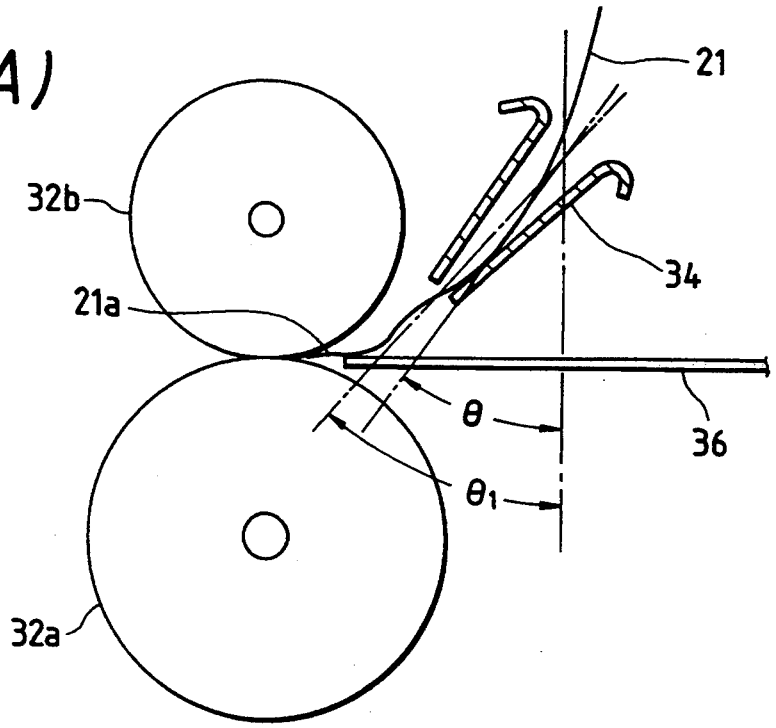
FIGS. 13(A) and 13(B) are side views for explaining a second method to put the leading edge of a curled sheet to the nip of each folding roller pair in the paper folding apparatus of the invention.

To gain the best posture of the leading edge 21*a* of the downward curled sheet, as shown in FIG. 13(A), the guide swing mechanism 40 further inclines the paper guide 34 up to an angle $\theta 1$ with respect to the guide plate 36. In the figure, the inclination of $\theta$ of the paper guide 34 is set up for a flat sheet of paper. Here, $\theta 1 > \theta$. When the downward curled sheet 21 is guided by the paper guide 34 inclined at the angle $\theta 1$, the leading edge of the sheet is guided as in the case of FIG. 12(A), so that it can smoothly and exactly enter the nip of the folding roller pair.

Figure 13B:
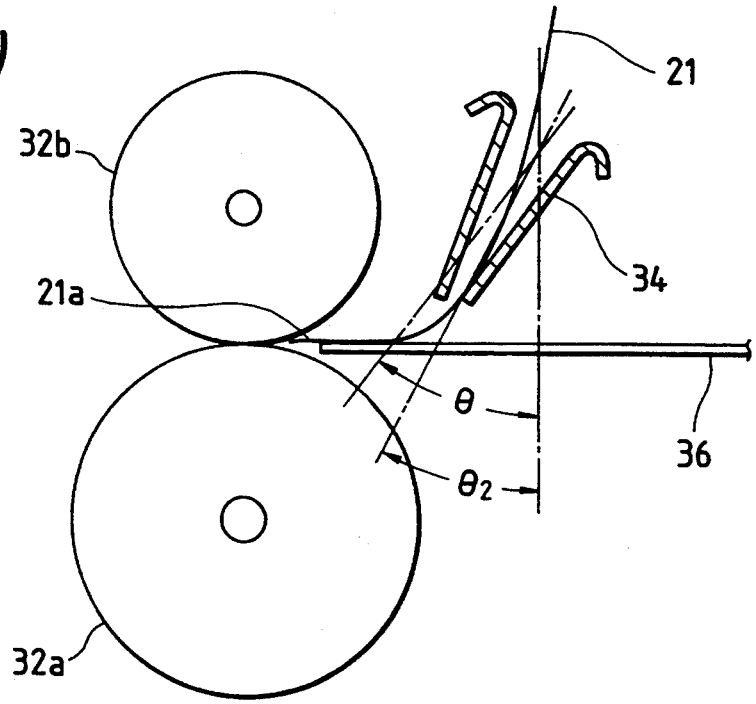

To gain the best posture of the leading edge 21*a* of the downward curled sheet, as shown in FIG. 13(B), the guide swing mechanism 40 less inclines the paper guide 34 up to an angle $\theta 2$, which is smaller than $\theta (\theta 2 < \theta)$. When the downward curled sheet 21 is guided by the paper guide 34 inclined at the angle $\theta 2$, the leading edge of the sheet is guided as in the case of FIG. 12(B), so that it can smoothly and exactly enter the nip of the folding roller pair.

While the first and second methods to gain the best posture of the paper leading edge have been described in connection with the first folding roller pair 32, the same thing is correspondingly applied for the second folding roller pair 33. In the copying machine 30, the roll of paper is set usually in a fixed direction. Accordingly, when the sheet guided to the first folding roller pair 32 is curled downward, it is curled upward in the second folding roller pair 33. Therefore, it is necessary to set the inclination angles of the paper guide 34 for the first and second folding roller pairs 32 and 33 to be different. This can readily be realized in a manner that the stopper positions of the solenoids 41 and 42 are made different.

In the instance as mentioned above, the inclination angles were: $\theta 1° = 30°$ and $\theta 2° = 25°$ . Those angles depend on the positional relationship among the paper guide 34, first and second folding roller pairs 32 and 33, and the feed roller pair 31.

It is evident to those skilled in the art that the solenoids of the height adjusting mechanism 50 may be replaced with other suitable means, such as a cam mechanism.

Figure 14:
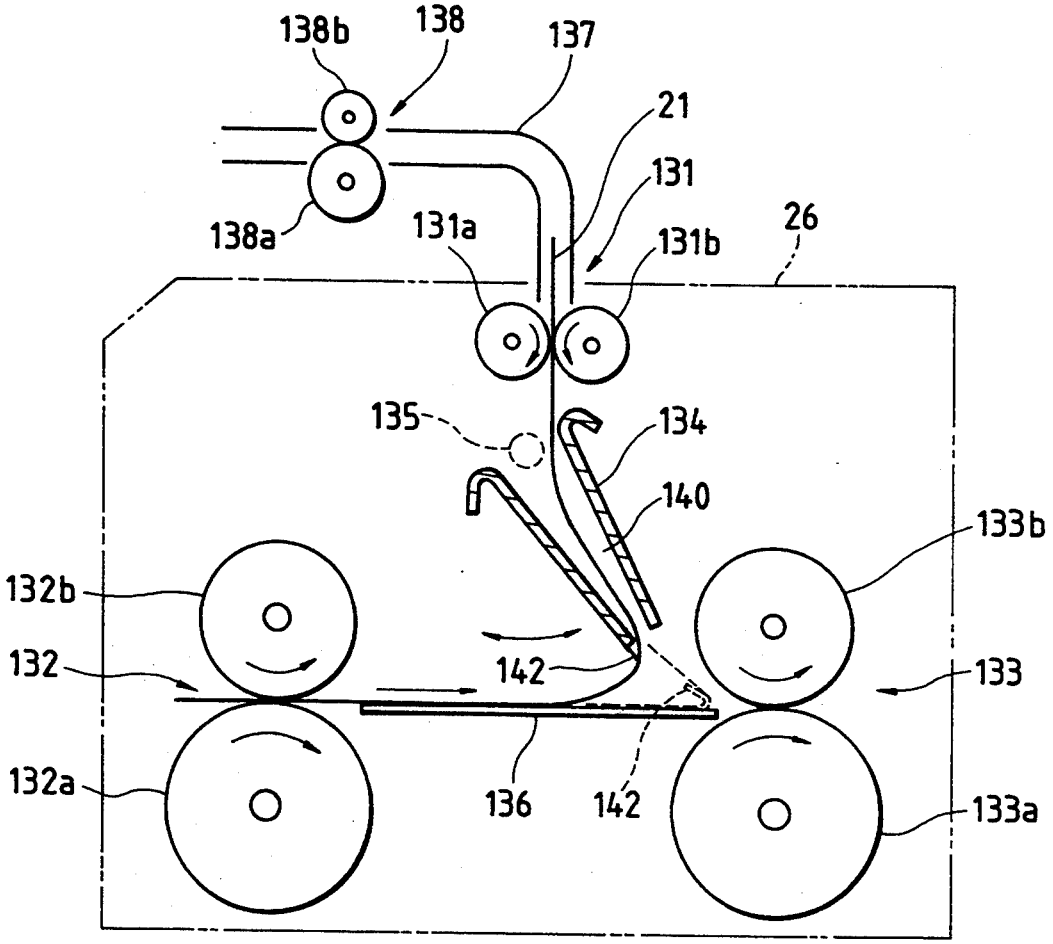
FIG. 14 is a side view schematically showing the construction of a second folding section in the paper folding apparatus of FIG. 6.

FIG. 14 is a side view schematically showing the construction of the second folding section in the paper folding apparatus.

As shown, the second folding section 26 includes a feed roller pair 131 consisting of a drive roller 131*a* and a pinch roller 131*b*, a first folding roller pair 132 consisting of a drive roller 132*a* and a pinch roller 132*b*, and a second folding roller pair 133 consisting of a drive roller 133*a* and a pinch roller 133*b*. Under the feed roller pair 131, the first and second folding roller pairs 132 and 133 are disposed symmetrically with respect to the vertical line extended down from the feed roller pair 131. The second folding section 26 further includes a paper guide 134 for guiding a sheet of paper 21 fed from the feed roller pair 131 selectively to the first or second folding roller pair.

Figure 15:
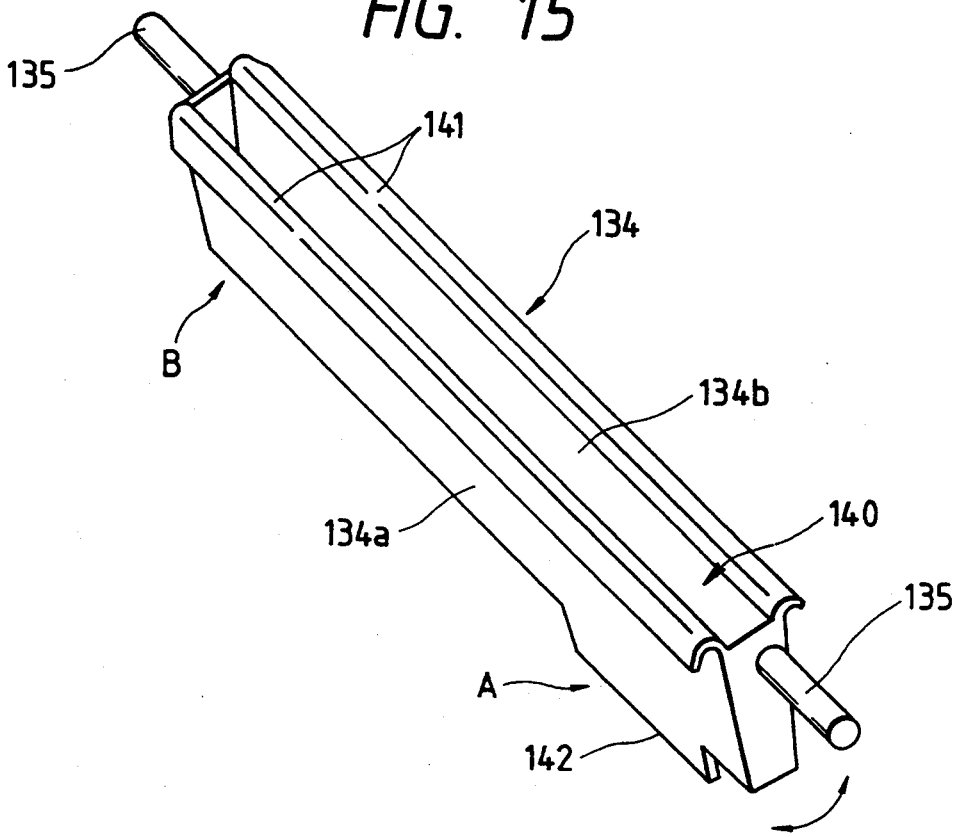
FIG. 15 is a perspective view showing the construction of a paper guide in the second folding section.
Figure 16:
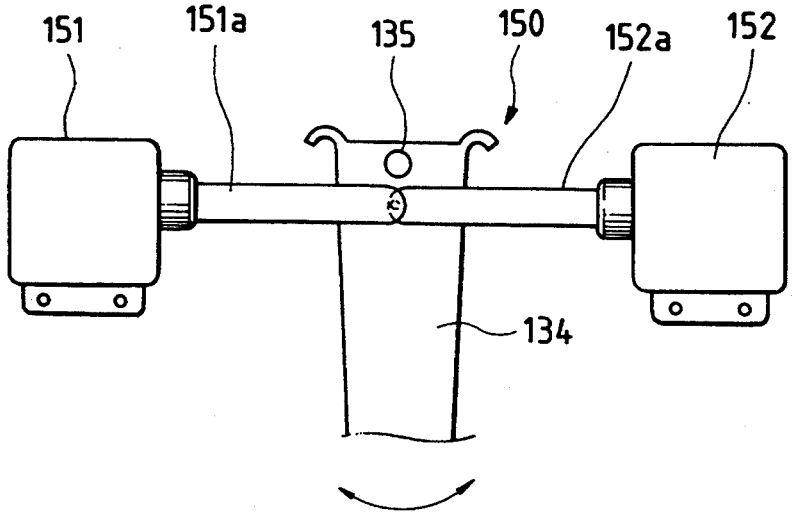
FIG. 16 is a side view showing a guide swing mechanism in the second folding section.

The paper guide 134 used in the second folding section 26 is perspectively illustrated in FIG. 15. As shown, the paper guide 134 contains a paper path 140 defined by a pair of side walls 134*a* and 134*b* oppositely disposed. The paper path 140 becomes narrower toward the bottom of the paper guide 134. An entrance opening of the paper guide 134, which is long and rectangular, is defined by the top sides of the side walls 134*a* and 134*b*, which are each outwardly curved to have a U-shaped flange portion 141 in cross section. The thus shaped top sides of the side walls 134*a* and 134*b* ensure a smooth reception of an incoming sheet.

The bottom side of the side wall 134*a*, which cooperates with the bottom side of the side wall 134*b* to form an exit opening of the paper guide 134, has an elongated protrusion 142 located closer to the end (indicated by an arrow A) of the paper guide 134 where, when the paper guide 134 receives the folded sheet, the creased side of the sheet 21, which was folded in the first direction by the first folding section 24 (FIG. 6), lies. The protrusion 142, when the second folding section 26 operates, forcibly presses down the creased side of the folded sheet 21 so that the creased side of the sheet as well as the other side, or the side not creased, of the sheet is smoothly put into the nip of the second folding roller pair 133. The operation of the elongated protrusion 142 serving as the creased-side pressing means will be described in detail later.

The paper guide 134 can be swung about aligned shafts 135 fastened to the near-top positions on both sides of the guide as viewed longitudinally, by a guide swing mechanism 150.

The guide swing mechanism 150 for swinging the paper guide 134 about the shafts 135 is shown in FIG. 6. As shown, the guide swing mechanism 150 includes a pair of solenoids 151 and 152, disposed on both sides of the paper guide 134. Drive links 151*a* and 152*a* are inwardly extended from the solenoids 151 and 152, and their distal ends reach under the shafts 135 and are coupled with each other. When the solenoids 151 and 152 are alternately energized, the paper guide 134 is swung within a range defined by a predetermined angle about the shafts 135.

Returning to FIG. 14, a paper guide plate 136, which is disposed between the first and second folding roller pairs 132 and 133, selectively leads the leading edge of the sheet 21 guided by the paper guide 134 to the nip of the first folding roller pair 132 or the second folding roller pair 133.

A feed roller pair 138 consisting of a drive roller 138*a* and a pinch roller 138*b* feeds the sheet 21, which was folded in the first direction by the first folding section 24 (FIG. 6), through a paper feed path 137 to between the rollers of the feed roller pair 131. The sheet 21 is fed into the paper guide 134 by means of the feed roller pair 131. Then, it is selectively guided, by means of the paper guide 134 to the first folding roller pair 132 or the second folding roller pair 133. When the first and second roller pairs 132 and 133 repeat the forward and reverse turns, the paper guide 134 swings about the shafts 135. The leading edge of the sheet 21 slides along the upper surface of the guide plate 136 to alternately be fed between the paired rollers of the roller pairs 132 and 133. In this way, the sheet 21 is progressively folded a desired number of times.

Figure 1:
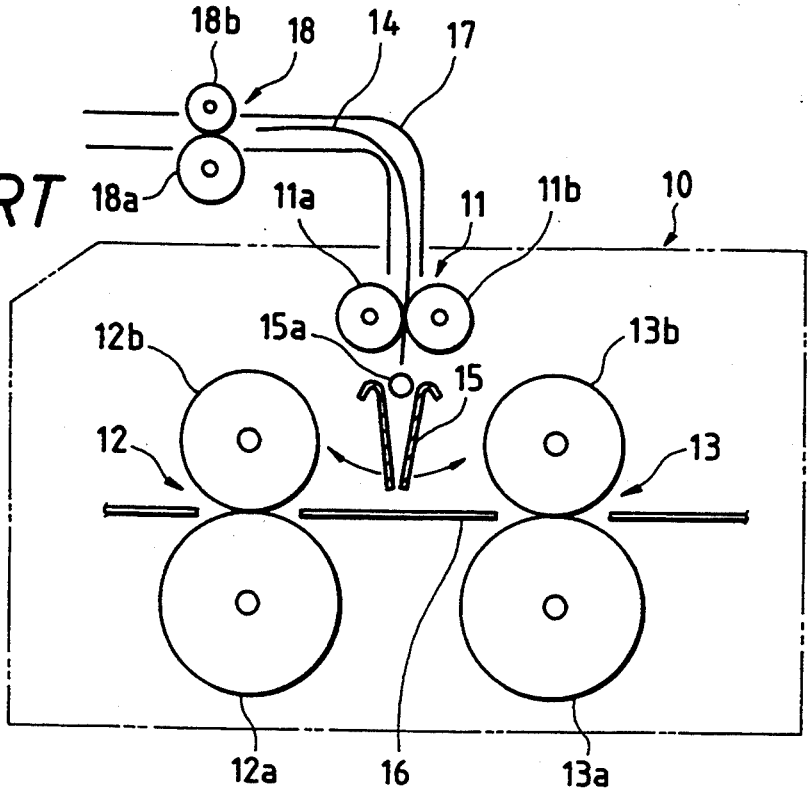
FIG. 1 PRIOR ART
FIG. 1 is a side view schematically showing the construction of a conventional paper folding apparatus.
Figure 2:
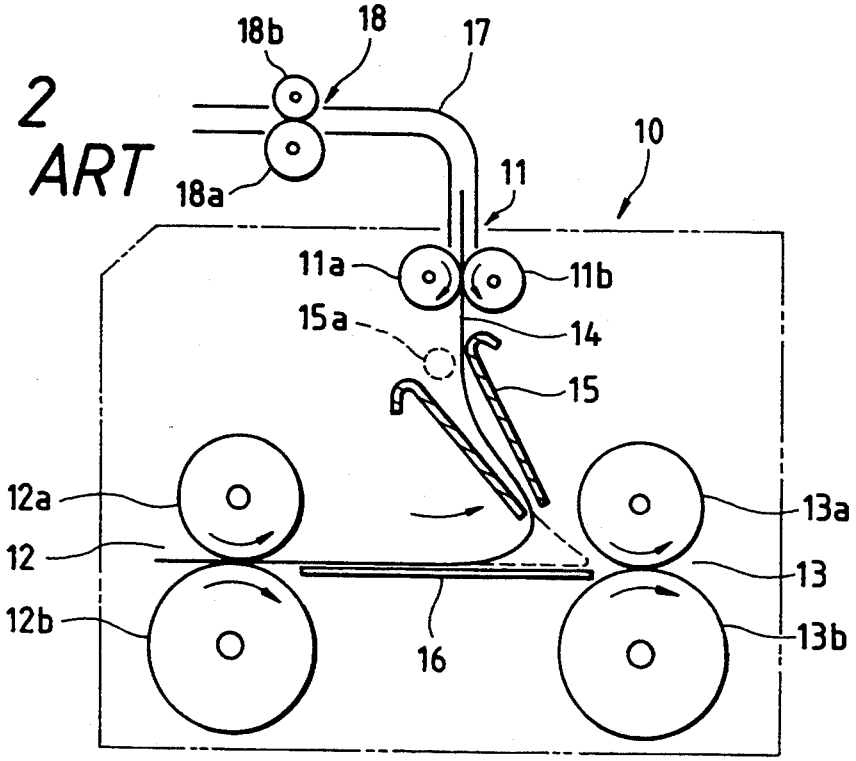
FIG. 2 PRIOR ART
FIG. 2 is a side view of the paper folding apparatus useful in explaining the folding operation of the paper folding apparatus.
Figure 3A:
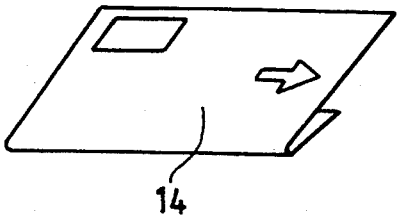
FIGS. 3(A) and 3(B) are diagrams showing examples of folded sheets of paper to be folded again in the different direction.
Figure 3B:
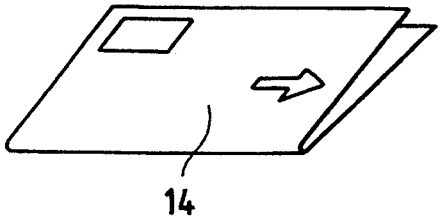
Figure 4A:
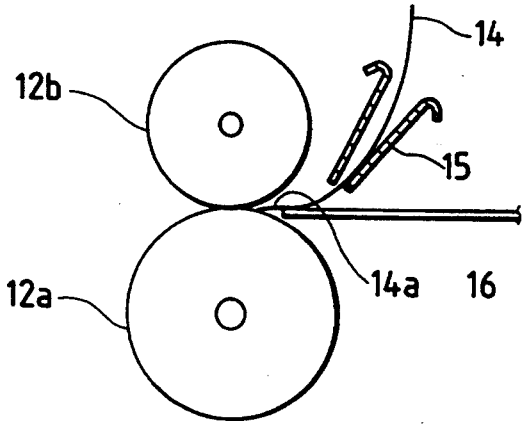
FIGS. 4(A) through 4(C) are side views showing how a flat sheet, an upward curled sheet, and a downward curled sheet are put into the nip of a folding roller pair.
Figure 4B:
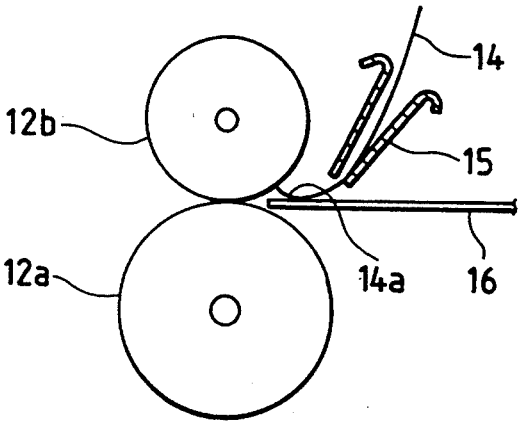
Figure 4C:
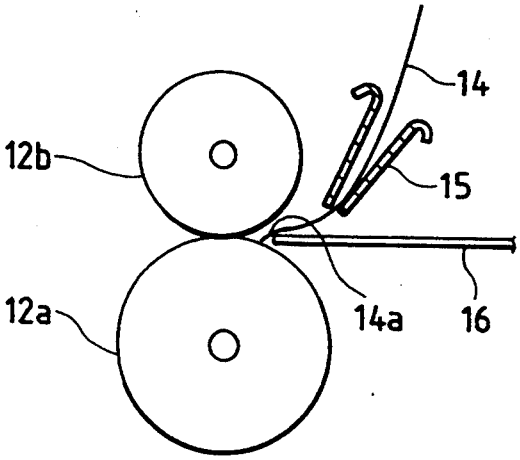
Figure 5:
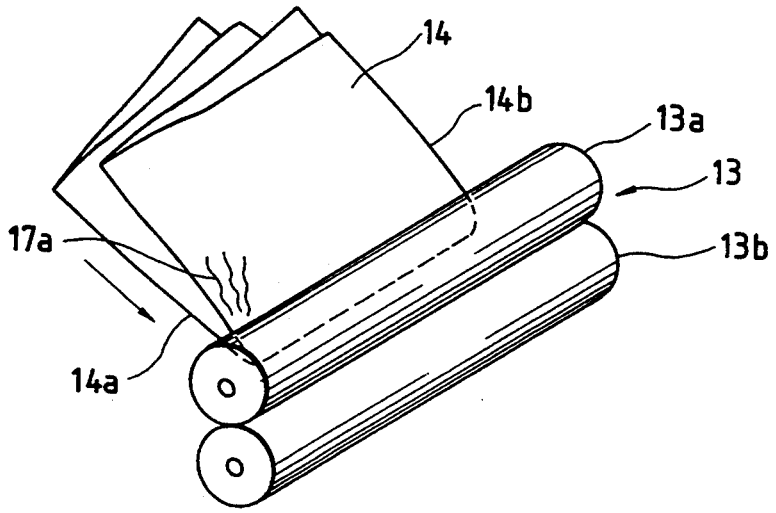
FIG. 5 is a perspective view showing a process in which wrinkle is created in the creased side of the folded sheet.

In the conventional paper folding apparatus, when the sheet of paper, which is folded in the first folding section 24 to have the creased side (see FIGS. 3(A) and 3(B)), is put into the nip of the folding roller pair 132 or 133, the creased side of the sheet to the nip is more impeded than the other side, not creased. It is noted here that the paper guide 134 includes the elongated protrusion 142 at the location where the creased side of the sheet lies when the paper guide receives the sheet in the embodiment. The elongated protrusion 142 functions in the following way. After the paper guide 134 pushes the leading edge of the sheet 21 into the nip of the first folding roller pair 132, it reversely turns toward the second folding roller pair 133, as shown in FIG. 14. At this time, the rollers of the first folding roller pair 132 also turn in the directions of arrows. With the cooperation of the turn of the paper guide 134 and the roller turn, the leading edge of the sheet is put into the nip of the second folding roller pair 133. During the reverse turn of the paper guide 134, the elongated protrusion 142 thereof presses down the creased side of the folded sheet 21. As a result, the folded sheet 21 is put into the nip of the second folding roller pair 133 uniformly over the entire width of the sheet. Accordingly, no wrinkle on the sheet is created.

Figure 17A:
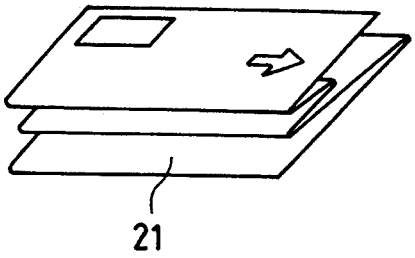
FIGS. 17(A) and 17(B) are diagrams showing two examples of printed sheets of which both sides (as viewed longitudinally) are folded.
Figure 17B:
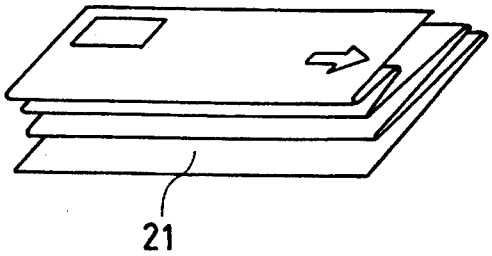

The above-mentioned paper guide 134, which is provided with the creased-side pressing means 142, can effectively operate for the folded sheet of which only one side of the folded sheet is creased, but ineffectively operate for the folded sheet of which both sides are creased, as shown in FIGS. 17(A) and 17(B). To cope with this, the creased-side pressing means 142 may be modified to have the constructions as shown in FIGS. 18 and 19.

Figure 18:
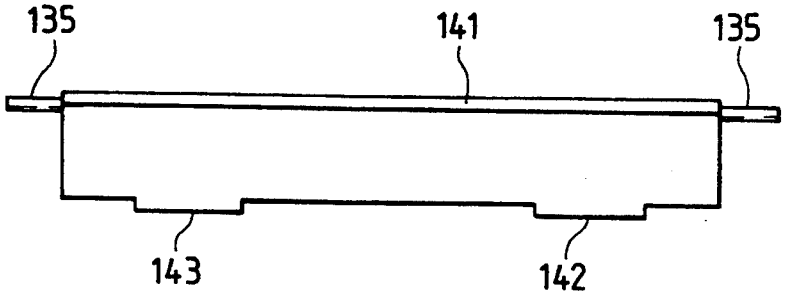
FIG. 18 is a front view showing a modification of the paper guide.

In the modification of FIG. 18, two protrusions 142 and 143 are integrally (in this instance) formed on the bottom side of one of the side walls 134*a* and 134*b* of the paper guide 134 at such locations as to press down both of the creased sides of the folded sheet 21.

Figure 19:
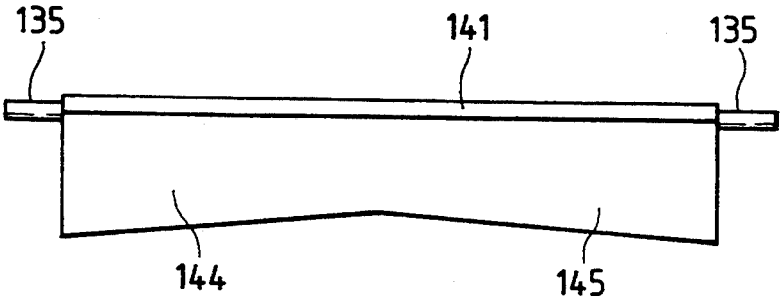
FIG. 19 is a front view showing another modification of the paper guide.

In the modification of FIG. 19, the bottom side of one of the side walls is tapered down from both ends thereof toward the center to form creased-side pressing means 144 and 145.

Figure 20:
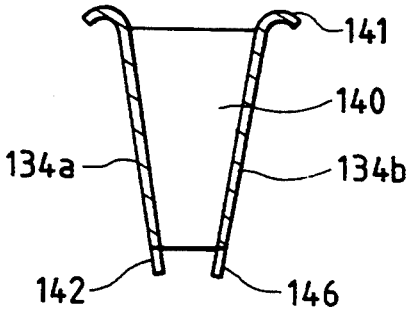
FIG. 20 is a cross sectional view showing yet another modification of the paper guide.

Further, the creased-side pressing means 142, 143, 144, and 145 may be formed on the bottom sides of both of the side walls 134*a* and 134*b* of the paper guide 134, as shown in FIG. 20. In this case, the folded sheet can be further smoothly put into the nip of the folding roller pair.

As described above, in the first folding section 24, the guide-plate height adjusting mechanism 50 as paper-thrust-posture adjusting means functions to adjust a posture of the leading edge 21*a* of the sheet 21 when it is forcibly put into the nip of the folding roller pair 32 or 33 according to a state (upward curl or downward curl) of the leading edge of the sheet 21 particularly when it is curled. With provision of the guide-plate height adjusting mechanism 50, the printed sheet, even if it is curled, can be smoothly and exactly put into the nip of the paired folding rollers. The wrinkle problem of the conventional apparatus can successfully be solved.

In the second folding section, the paper guide 134 as swingable, paper guide means, which guides the folded sheet delivered from the first folding section selectively to the first folding roller pair 132 or the second folding roller pair 133, has the creased-side pressing means 142, 143, 144, and 145 for pressing the creased side of the folded sheet. With provision of the creased-side pressing means, the sheet with the creased side can be put into the nip of the paired folding rollers uniformly over its entire width. Accordingly, it can be smoothly and exactly put into the nip of the paired folding rollers, without creasing any wrinkle.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A paper folding apparatus comprising:

a feed roller pair for feeding a sheet of paper;

a first folding roller pair;

a second folding roller pair, disposed in opposition to said first folding roller pair, for folding the sheet of paper fed from said feed roller pair in cooperation with said first folding roller pair;

swingable paper guide means, disposed above said first and second folding roller pairs, for guiding the sheet of paper fed from said feed roller pair selectively to said first folding roller pair or said second folding roller pair;

a paper guide plate, disposed between said first and second folding roller pairs, for leading a leading edge of the sheet of paper guided by said paper guide means to a nip portion of said first folding roller pair or said second folding roller pair; and paper-thrust-posture adjusting means for adjusting a posture of the leading edge of the sheet of paper when the sheet is forcibly put into said nip portion according to a state of the leading edge of the sheet, determined by the number of folds made to the sheet, particularly when the sheet is curled.

2. A paper folding apparatus comprising:

a feed roller pair for feeding a sheet of paper;

a first folding roller pair;

a second folding roller pair, disposed in opposition to said first folding roller pair, for folding the sheet of paper fed from said feed roller pair in cooperation with said first folding roller pair;

swingable paper guide means, disposed above said first and second folding roller pairs, for guiding the sheet of paper fed from said feed roller pair selectively to said first folding roller pair or said second folding roller pair;

a paper guide plate, disposed between said first and second folding roller pairs, for leading a leading edge of the sheet of paper guided by said paper guide means to a nip portion of said first folding roller pair or said second folding roller pair; and paper-thrust-posture adjusting means for adjusting a posture of the leading edge of the sheet of paper, when the sheet is forcibly put into said nip portion, according to a curling direction of the leading edge of the sheet, wherein said paper-thrust-posture adjusting means includes a paper-guide-inclination angle adjusting mechanism for adjusting an angle of inclination of said paper guide means according to a curled state of the leading edge of the sheet.

* * * * *

UNITED STATES PATENT AND TRADEMARK OFFICE

CERTIFICATE OF CORRECTION

PATENT NO. : 5,425,696

DATED : June 20, 1995

INVENTOR(S) : Akihiko HARA et al.

It is certified that error appears in the above-indentified patent and that said Letters Patent is hereby corrected as shown below:

ABSTRACT, LINE 5 AFTER "a first folding roller pair" INSERT --and--; AND

LINE 18 AFTER "Finally" INSERT --,--.

CLAIM 1, COLUMN 11, LINE 23 AFTER "paper" INSERT --,--;

LINE 24 AFTER "portion"INSERT --,--;

LINE 25 "state" SHOULD READ --curling direction--;

UNITED STATES PATENT AND TRADEMARK OFFICE

CERTIFICATE OF CORRECTION

PATENT NO. : 5,425,696

DATED : June 20, 1995

INVENTOR(S) : Akihiko Hara et al.

It is certified that error appears in the above-indentified patent and that said Letters Patent is hereby corrected as shown below:

CLAIM 1, COL. 11 LINES 26 & 27 ", determined by the number of folds made to the sheets, particularly when the sheet is curled." SHOULD READ --wherein said paper-thrust-posture adjusting means includes a guide-plate height adjusting mechanism for adjusting a height of said paper guide plate according to a curled state of the leading edge of the sheet.--

Signed and Sealed this

Second Day of July, 1996

*Attest:*

*Attesting Officer*

BRUCE LEHMAN

*Commissioner of Patents and Trademarks*